US007866137B2

(12) United States Patent
Kline et al.

(10) Patent No.: US 7,866,137 B2
(45) Date of Patent: Jan. 11, 2011

(54) RECYCLABLE CHENILLE YARN

(76) Inventors: Ann Margaret Kline, 23801 Laurchwood La., Valencia, CA (US) 91354; Johnny Hughes, 364 Fork Hills Rd., Heath Springs, SC (US) 29058

( * ) Notice: Subject to any disclaimer, the term of this patent is extended or adjusted under 35 U.S.C. 154(b) by 0 days.

(21) Appl. No.: 11/739,588

(22) Filed: Apr. 24, 2007

(65) Prior Publication Data

US 2007/0251206 A1 Nov. 1, 2007

Related U.S. Application Data

(60) Provisional application No. 60/796,327, filed on Apr. 27, 2006.

(51) Int. Cl.
*D02G 3/02* (2006.01)

(52) U.S. Cl. ..... 57/203

(58) Field of Classification Search ..... 57/24, 57/203

See application file for complete search history.

(56) References Cited

U.S. PATENT DOCUMENTS 3,889,034 A 6/1975 Lenards et al.
4,517,715 A * 5/1985 Yoshida et al. ..... 28/144
5,428,969 A 7/1995 Day et al.
5,651,168 A 7/1997 Tung et al.
5,883,199 A * 3/1999 McCarthy et al. ..... 525/437
6,107,218 A 8/2000 Rice
6,588,192 B1 7/2003 Rice
7,117,899 B1 10/2006 Kim
2004/0182064 A1 * 9/2004 Yahata et al. ..... 57/1 R
2005/0080223 A1 * 4/2005 Tuominen et al. ..... 528/272
2006/0014016 A1 * 1/2006 Lardizabal et al. ..... 428/375

OTHER PUBLICATIONS

Kathryn L. Hatch, Textile Science, 1993, West Publishing Company, 1st edition, pp. 140, 308.*
http://www.yarnmarket.com/yarn/Crystal_Palace_Yarn-Cotton_Chenille_Yarn-1468.html (Jun. 19, 2005).*

* cited by examiner

*Primary Examiner*—Shaun R Hurley
(74) *Attorney, Agent, or Firm*—Christie, Parker & Hale, LLP

(57) ABSTRACT

A recyclable chenille yarn has a core yarn or core yarns, and effect yarns, of natural fiber materials. The core yarn or yarns hold the effect yarns by twisting the yarns together, so that no binder is necessary or used. Accordingly, the chenille yarn is biodegradable and readily recyclable. Preferred natural fibers for the yarns include bamboo, kudzu, potato, alpaca, banana, coconut, kenaf and soybean.

2 Claims, 3 Drawing Sheets

RECYCLABLE CHENILLE YARN

CROSS-REFERENCE TO RELATED APPLICATION(S)

This application claims the benefit of U.S. Provisional Patent Application No. 60/796,327 filed Apr. 27, 2006, the disclosure of which is hereby incorporated by reference herein.

FIELD OF THE INVENTION

The present invention is directed to a new recyclable chenille yarn and a method of making the chenille yarn, and more specifically to a composite chenille yarn comprising a feeder stock flat yarn as a core yarn and an outer chenille yarn as the effect yarn. Both the core yarn and the effect yarn are made from a natural recyclable material, namely, bamboo, kudzu, tobacco, banana, alpaca, coconut, potato, cotton, kenaf or soybean.

BACKGROUND OF THE INVENTION

Chenille yarn has become the choice of fabric designers for many items because of its beautiful appearance, softness and durability. Chenille is a pile yarn that has been produced commercially since the 1970's. Chenille yarn consists of short lengths of spun yarn or filament that are held together by two ends of highly twisted, fine strong yarn. The short lengths are called the pile and the highly twisted yarns are called the core. Previously, chenille yarns have been made from different types of fibers and yarns, most commonly cotton, rayon, acrylic and polypropylene. Chenille yarn is manufactured on a machine that is designed to bring the pile yarns and core yarns together. During manufacture, the pile yarns are wrapped around a short stem of polished metal, called a caliper, through which a blade passes to cut the pile yarns into short lengths. The core yarns are pressed onto the short lengths with a rotating metal wheel. The resulting yarn is then fed onto a traditional ring twisted take-up mechanism. In the twisting process, the two ends of the core yarn twist and trap the short ends of pile between the core yarns. The size of the caliper determines the diameter of the resulting yarn. The size and number of the pile yarns and how much of them are fed onto the core determines the count of the yarn.

There has been a recent movement within the textile industry to incorporate recyclable or "green" products which are environmentally friendly. Previous chenille yarns, although incorporating some natural components such as cotton, normally use synthetic, petroleum based, chemical or plastic materials as components for the effect yarn and/or the core yarn. In addition, non-natural binder materials often are incorporated to hold together the pile to the core. The use of these materials is not environmentally friendly in that they do not breakdown in landfills or are prohibitively expensive or impossible of being recycled. Consequently, a need exists for a new recyclable chenille yarn which incorporates natural fibers.

SUMMARY OF THE INVENTION

The present invention is a new chenille yarn incorporating novel natural components as the core component and the effect component. The chenille yarn of the present invention is a composite yarn comprising a feeder stock flat yarn and an outer chenille yarn. One novel aspect of the present invention is the use of a single, natural raw material for one or both of the core yarn and the effect yarn. The single raw material contemplated by the present invention is one of bamboo, kudzu, potato, tobacco, alpaca, kenaf or soybean. Other natural raw materials available for use with the present invention include coconut, banana and silk. The raw material is harvested in a typical method for the specific raw material. The raw material is prepared by a method known as blending and carding into silver. The fiber or silver, then is subjected to a process known as roving. The roving material is then spun into threads from which the threads are made into yarn. Alternatively, if the raw material can be reduced to a liquid state it is extruded into a filament for use in making the yarn.

The threads or filament are twisted together to produce the yarn in a number that corresponds with the desired diameter commonly known as denier or yards per pound (ypp). The yarns are manufactured into various deniers or sizes based on the specifics required for performance, durability, aesthetics and desired scale. Although less desirable, specific applications may also incorporate for one of the effect or core components the use of polyester, rayon, linen, nylon or polypropylene. These non-natural components are less desirable because they are less environmentally friendly.

BRIEF DESCRIPTION OF THE DRAWINGS

By way of example, embodiments of the present invention will now be described with reference to the accompanying drawings, of which.

DETAILED DESCRIPTION OF THE INVENTION

Figure 1:
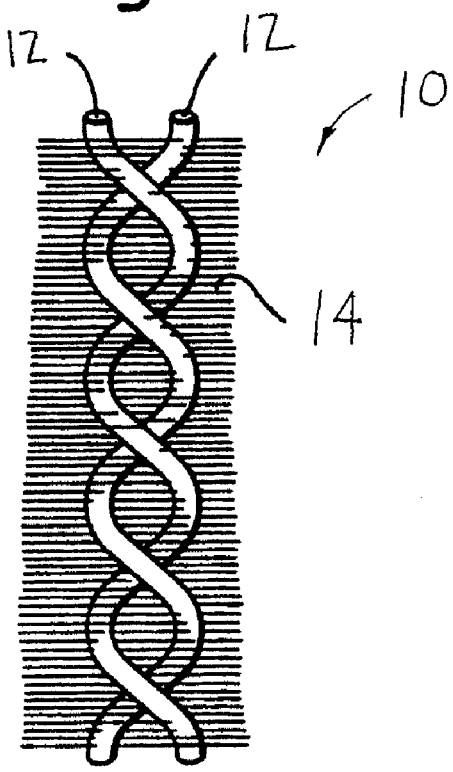
FIG. 1 is a side elevational view of a chenille yarn of the present invention.
Figure 2:
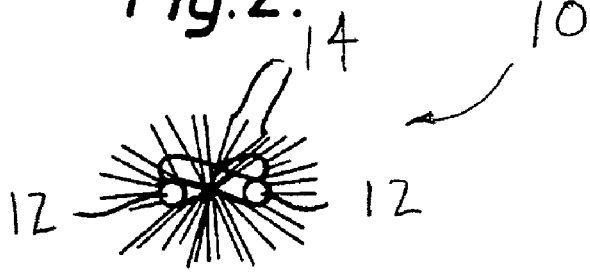
FIG. 2 is an end view of the yarn of FIG. 1.

FIGS. 1 and 2 illustrate a recyclable chenille yarn 10 of the present invention. The chenille yarn 10 illustrated comprises a pair of flat core yarns 12 which are twisted together as shown. Trapped between the core yarns 12 are short pieces of effect yarn 14 which form a pile on the chenille yarn 10. As can be seen in FIG. 2, the effect yarn extends all around the composite chenille yarn as the core yarns are twisted about a longitudinal access. The yarn illustrated can be produced in numerous ways, as will be discussed in more detail herein, by simultaneously twisting together the core yarns while trapping the effect yarns there between to form the chenille assembly. In one form of construction, the effect yarns are trapped between the core yarns solely by friction resulting from the twisting together of the core yarns. In an alternative type of construction, the effect yarns are bonded to the elongate core yarns by incorporating a bonding agent as a third component.

To be environmentally friendly and recyclable, the chenille yarn 10 of the present invention incorporates unique raw materials as the core yarn and the effect yarn. The preferred raw material for use as the core yarn and the effect yarn is selected from the group of bamboo, kudzu, potato, tobacco, alpaca, kenaf and soybean. Other natural fibers which can be used for the core yarn or the effect yarn include banana, coconut, silk, rayon, linen or cotton. By incorporating these natural raw materials for the individual core yarn and the effect yarn, they are environmentally friendly in that they will naturally breakdown in landfills or are easily recycled. The chenille yarn of the present invention is manufactured for an intended use in the weaving of residential and commercial upholstery, drapery, bedding and designer textiles. After the conclusion of its useful life after its intended use, the elements of the chenille yarn can be separated for recycling purposes in accordance with local recycling centers. A recommended method of separation is through a hot water bath, whereby the effect yarn breaks down into its natural cellulose state and the core yarn will melt or pull away from the effect yarn so that the individual elements can then be recycled.

Although less desirable, for specific applications, one of either the effect yarn or the core yarn can incorporate non-natural materials such as polypropylene, polyethylene, polyester, or other petrochemical products. Although these non-natural components are less desirable from an environmental and recyclability aspect, there is an improvement in environmental and recyclable aspects in that at least one of the components would include the natural raw materials such as bamboo, kudzu, potato, tobacco, alpaca, kenaf, soybean, cotton, coconut, banana and silk.

The chenille yarn of the present invention can be produced in its natural state without color, with its natural color or can be dyed to a specific application. The core yarn could also be dyed to match the natural color of the chenille yarn and vice-versa. To add color, dyeing of the composite chenille yarn is done by either package dyeing or piece dyeing when manufactured into a woven fabric. Package dyeing is commenced when the individual elements of the yarn are in their separate states as raw material or as flat yarn. The process for dyeing can be environmentally green or performed with standard commercial dyeing chemicals and processes. Piece dyeing can take place when the yarn is woven into textiles or other finished goods. This process also can be done environmentally or through standard commercial dyeing chemicals and processes.

Figure 3:
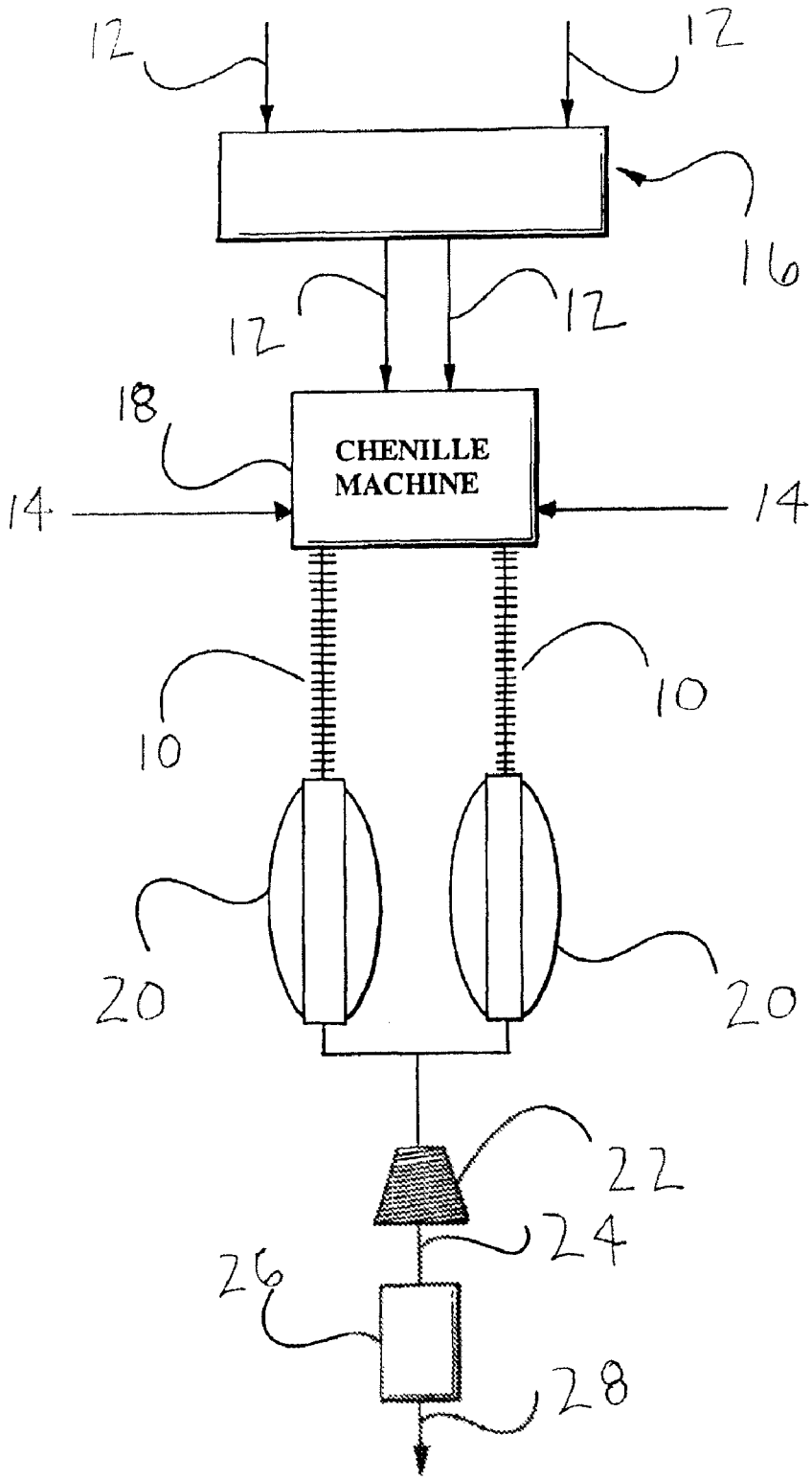
FIG. 3 is a schematic representation of the process steps for forming a chenille yarn of the present invention.

Referring to FIG. 3, one method of producing the chenille yarns 10 of the present invention is schematically illustrated. As few as one and as many as six high strength flat feeder core yarns 12 are fed into an optional tacking machine 16. Tacking machine 16 mechanically attaches a binder material, if desired, by one or more methods including, but not limited to, air texturizing, taslan, air entanglement, hollow spindle twisting and novelty twisting. One or more core yarns 12 exit the tacking machines and are fed into a chenille machine 18. It is to be understood that the core yarns 12 can be fed to the chenille machine without going through a tacking machine. Effect yarns 14 are also fed to the chenille machine and the core yarns and effect yarns are combined to produce the composite chenille yarn 10. As the chenille yarn 10 exits the chenille machine, the chenille yarns are taken up on bobbins 20 and subsequently transferred onto cones 22. The cone is then transferred 24 into a packaging 26 for shipment 28 to a weaving process for textiles.

The chenille machine 18 is designed to bring the effect yarn and the core yarns together. During manufacture, the effect yarns are wrapped around a caliper through which a blade passes to cut the effect yarns into short lengths as is known in the industry. The core yarns are pressed into the short lengths with a rotating metal wheel and the resulting yarn is fed onto a traditional ring twisting take-up mechanism. In the twisting process, as few as one and as many as six ends of the core yarn twist and trap the short ends of the pile between the core yarns. The size of the caliper determines the diameter of the resulting yarn and the size and number of the pile of yarns and how much of them are fed into the core determines the count of the yarn. For example, the denier of the feeder stock yarn ranges from 150 to 3000 in size.

Figure 4:
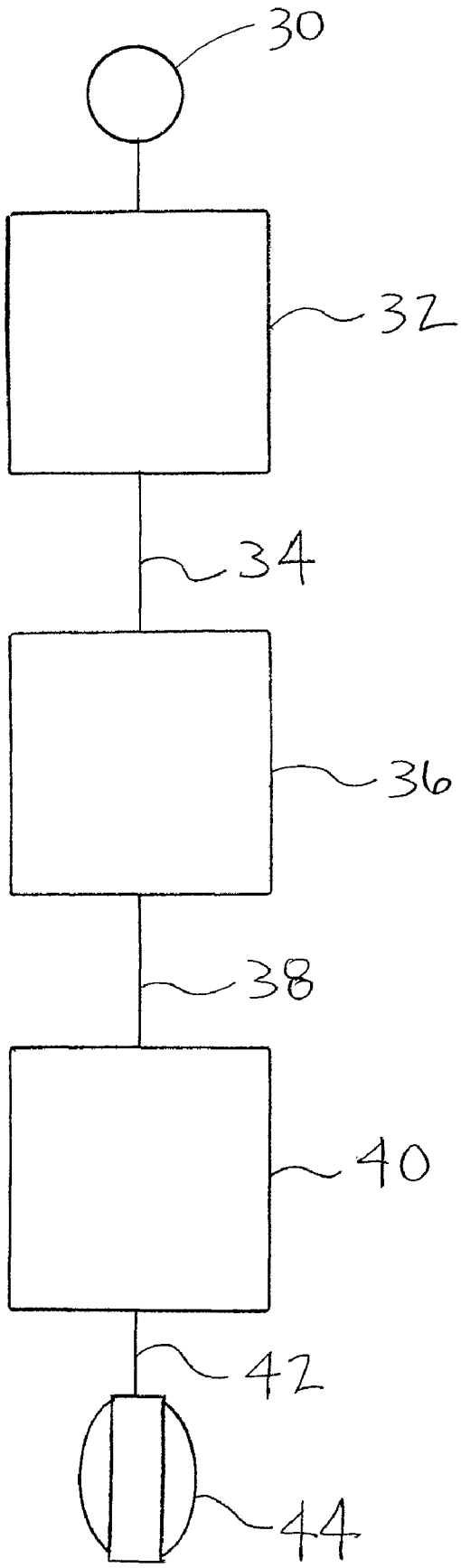
FIG. 4 is a schematic representation of the process steps for forming the core yarn and/or the effect yarn as a component of the chenille yarn.

Referring to FIG. 4, production of the flat core yarn is illustrated. As previously mentioned, the flat core yarn can also be made from a single raw material including bamboo, kudzu, potato, tobacco, alpaca, kenaf, soybean, coconut, banana, cotton and silk. This raw material is harvested in a typical method for the specific material and placed into a raw staple fiber bale 30. The raw material bale is blended and carded into silver in a silver machine 32. The carded silver 34 goes through a drawing preparation, is twisted and then made into roving 38 in a roving machine 36. The roving 38 enters a spinning frame 40 where it is spun into thread 42 and collected on bobbin 44. The threads then are made into yarn. Alternatively, the raw material, such as soybean, is reduced to a liquid state and extruded into a filament ranging from 20,000 denier or 223.2 yards per pound (ypp) to 1.000 denier or 4,465,000 ypp. The threads are then twisted together into yarn in a number that corresponds with the desired diameter.

EXAMPLE

The method of making a bamboo chenille yarn includes processing raw bamboo material into an effect yarn as per the method discussed with respect to FIG. 4. The bamboo effect yarn is placed on a chenille machine creel. The core yarn, such as cotton, is also placed into the chenille machine creel. The effect yarn is 100% bamboo and the core yarn is 20/2, 100% cotton. The cotton core yarn includes as few as one and as many as six ends which comprises 25% of the overall bamboo chenille yarn. The effect yarn is 100% 8/1 bamboo which comprises 75% of the finished bamboo chenille yarn. The bamboo chenille yarn is a 100% recyclable product and the yarn can range between 500 and 3000 ypp. As few as one and as many as six ends of the core yarn and as few as one and as many as seven ends of the bamboo effect yarn are processed in the chenille machine, as discussed regarding FIG. 3, to produce the bamboo chenille yarn. The finished bamboo chenille yarn is then packaged and sent for the next process of weaving into textiles.

Although the present invention has been described and illustrated with respect to preferred embodiment herein, it is to be understood that changes and modifications can be made herein which are within the intended scope of the invention as hereinafter claimed.

What is claimed is:

1. A chenille yarn comprising a first core yarn and a second core yarn, and multiple effect yarns, wherein the multiple effect yarns are fixed to the first and second core yarns by twisting the first and second core yarns around the multiple effect yarns so wherein the first yarn, the second core yarn and the effect yarns are a naturally processed cellulose raw material and wherein the cellulose raw material is chemically unaltered potato or tobacco fibers.

2. The chenille yarn of claim 1, wherein the first core yarn, the second core yarn, and the multiple effect yarns are biodegradable.

* * * * *